US005594999A

United States Patent [19]

Best

[11] Patent Number: 5,594,999

[45] **Date of Patent: *Jan. 21, 1997**

[54] RADIANT WALL OVEN AND PROCESS FOR GENERATING INFRARED RADIATION HAVING A NONUNIFORM EMISSION DISTRIBUTION

[75] Inventor: Willie H. Best, Columbia, S.C.

[73] Assignee: Haden Schweitzer Corporation, Madison Heights, Mich.

[ * ] Notice: The portion of the term of this patent subsequent to Jul. 27, 2010, has been disclaimed.

[21] Appl. No.: 39,928

[22] Filed: Mar. 29, 1993

Related U.S. Application Data

[63] Continuation-in-part of Ser. No. 702,109, May 15, 1991, Pat. No. 5,230,161.

[51] Int. Cl.[6] ..... F26B 3/30

[52] U.S. Cl. ..... 34/270; 34/272

[58] Field of Search ..... 34/39, 40, 41, 34/60, 68, 17, 1 W, 1, 270, 272, 271, 308, 420, 421; 432/10, 18, 31, 171, 175; 118/641, 642

[56] References Cited

U.S. PATENT DOCUMENTS 5,230,161 7/1993 Best ..... 34/39

*Primary Examiner*—Henry A. Bennett
*Assistant Examiner*—Dinnatia Doster
*Attorney, Agent, or Firm*—Hopkins & Thomas

[57] ABSTRACT

Radiant emitting walls enclose opposite sides of a central combustion chamber in an oven where coated objects to be dried are placed or passed. The radiant emitting walls generate primarily infrared radiation and have a nonuniform temperature distribution so that the temperature of the lower portion of the oven can be selectively adjusted to be significantly higher than the temperature of the upper portion. An insulated outer housing surrounds the radiant walls and defines combustion chambers each having a linear burner which runs substantially the entire length of the radiant emitting walls. The lower portions of the radiant emitting walls receive energy primarily from radiation from the linear burners and the upper portions of the radiant emitting walls receive energy from primarily radiation from the interior radiant emitting surfaces of the insulated outer housing and convection from the linear burners. The temperature distribution of the radiant emitting walls can be selectively varied by varying the distance between the burners and the radiant emitting walls.

57 Claims, 3 Drawing Sheets

RADIANT WALL OVEN AND PROCESS FOR GENERATING INFRARED RADIATION HAVING A NONUNIFORM EMISSION DISTRIBUTION

This document is a continuation-in-part of parent application Ser. No. 07/702,109 filed May 15, 1991, for APPARATUS AND PROCESS FOR GENERATING RADIANT ENERGY by Willie H. Best, now U.S. Pat. No. 5,230,161, the disclosure of which is incorporated herein by reference as if set forth in full hereinbelow.

FIELD OF THE INVENTION

The present invention generally relates to ovens and processes for drying coated objects and is more particularly concerned with a radiant wall oven of modular construction having radiant emitting walls for generating infrared radiation having a nonuniform emission distribution.

BACKGROUND OF THE INVENTION

In many applications for the type of oven described by my U.S. Pat. Nos. 4,546,553 and 4,546,553, it is extremely beneficial to emit primarily infrared radiation and to emit more radiant energy at the lower half of the oven than at the upper half. U.S. Pat. No. 4,546,533 suggested that an ideal intensity of the radiant energy for drying and curing coatings occurs when the majority of the total energy emitted is radiated at wavelengths of about 5 microns or greater, i.e., at wavelengths within the infrared electromagnetic spectrum. Moreover, the need to emit more radiant energy at the lower half of the oven than at the upper half is apparent in applications where the heavier mass of the object to be heated or dried is substantially concentrated on the lower portion of the object. Examples of objects of this nature include an automotive body or a truck body. Along these lines, it has been well known in the industry for years that, in general, the hardest exterior surface to cure on a vehicle body is the rocker panel, which is the panel located just under the doors of the vehicle body.

In most of the prior art apparatuses, including the embodiments which are described in my U.S. Pat. Nos. 4,546,552 and 4,546,553, the oven architecture generally limits the degree of control over the temperature distribution of the radiant emitting walls of the ovens. In some oven embodiments, the products of burner combustion, along with excess air, are delivered at a uniform temperature to a chamber, which is defined by walls including the emitting wall, for the purpose of heating the emitting wall uniformly. In other oven embodiments, the combustion chamber is direct-fired with a burner and the products of burner combustion within the combustion chamber are agitated or made turbulent, as further described in U.S. Pat. No. 4,546,553, so as to achieve a uniform temperature distribution on the emitting wall. It should be noted that when the products of burner combustion contained in the combustion chamber are made turbulent, the forced-convection heat transfer coefficient is much greater than when there is laminar flow within the combustion chamber. Therefore, the heat transferred to the radiant emitting wall is primarily forced-convection heat transfer, and the heat transferred by infrared radiation to the radiant emitting wall is essentially insignificant.

In the parent application with Ser. No. 07/702,109, for APPARATUS AND PROCESS FOR GENERATING RADIANT ENERGY, now U.S. Pat. No. 5,230,161, the temperature distribution along the radiant emitting wall is selectively varied by varying the cross sectional area of the combustion chamber, defined by the emitting surface and another wall, through which flow products of burner combustion. The foregoing method of varying the temperature distribution has proven to be very satisfactory. However, this method requires at least two surfaces to contain the products of combustion throughout their path of travel, which predicament is oftentimes undesirable. Moreover, in the previous oven embodiment, it is difficult to achieve very high temperatures at the lower portion of the oven as compared with the upper portion thereof.

Thus, there is a heretofore unaddressed need in the industry for a radiant wall oven and process for generating infrared radiation having a nonuniform temperature distribution so that the temperature of the lower portion of the radiant wall can be selectively adjusted to be significantly higher than the temperature of the upper portion.

SUMMARY OF THE INVENTION

Briefly described, the present invention is a radiant wall oven and a process for generating primarily infrared radiation having a nonuniform temperature distribution so that the temperature of the lower portion of the radiant wall can be selectively adjusted to be significantly higher than the temperature of the upper portion. The radiant wall oven has a pair of opposed radiant emitting walls for directing infrared radiant energy, a majority of which is emitted at wavelengths of about 5 microns or greater, toward a vertical plane along a longitudinal center line of the oven where objects are heated. The radiant emitting walls are heated from a combustion process which takes place in a linear burner disposed within an insulated combustion chamber running adjacent to the radiant emitting walls for substantially the entire length thereof. The oven optionally can be constructed modularly with two mirror image radiant emitting wall modules, a roof and a floor, although this is not required to practice the invention.

The temperature distribution in the vertical dimension of each radiant emitting wall can be selectively varied by selectively manipulating the distance between the burner combustion surface of the linear burner and the radiant emitting wall. Preferably, the distance is approximately between 3 and 20 inches. Because there is no forced turbulence within the combustion chambers of the novel oven, the amount of heat that is transferred to the radiant emitting walls by infrared radiation from the internal surfaces of the combustion chambers becomes significant and varies from about 30 percent to 70 percent of the total amount of infrared radiation energy that is emitted by the radiant emitting walls and onto the processed object. In essence, the lower portion of each radiant emitting wall receives radiant energy directly from the burner surface and radiation from the interior radiant emitting surfaces and from convective heat transfer from the products of combustion. The upper portion of the wall receives energy by radiation from the interior emitting surfaces of the combustion chamber and by convective heat transfer from the products of combustion.

In my U.S. Pat. No. 4,546,533, it was suggested that an ideal intensity of the radiant energy for drying and curing coatings exists when the majority of the total energy emitted is radiated at wavelengths of about 5 microns or greater. This ideal emission level is quite easily obtainable within an oven described by the present invention by operating the input to the linear burners within a range of approximately 3,000 to 35,000 BTUH per foot of radiant emitting wall in the longitudinal direction within the oven at equilibrium temperature. The equilibrium temperature of the oven is defined as the operating condition of the oven when it has reached its desired operating temperature and the temperatures of the radiant emitting walls have been stabilized within operating limits of the oven. The oven can be at equilibrium temperature with or without the thermal load of the processed object.

Accordingly, it is an object of the present invention to provide a radiant wall oven in which the temperature distribution in the vertical dimension of the oven and radiant emitting walls can be selectively varied.

Another object of the present invention is to provide a process by which radiant energy emitted from the lower half of an oven can be much greater, for instance, double or triple, than the amount of radiant energy emitted from the upper half of the oven.

Another object of the present invention to provide a radiant wall oven which emits energy at wavelengths primarily greater than about 5 microns. The foregoing can be accomplished by operating the input to the burners between about 3,000 and 35,000 BTUH per foot of radiant wall measured in the longitudinal direction of the oven.

Another object of the present invention is to provide an oven for delivering infrared radiation for drying coated objects that will not require an energy input any greater than 35,000 BTUH per foot of radiant wall measured in the longitudinal direction when operating at equilibrium temperatures.

Another object of the present invention is to provide a radiant wall oven in which the radiant emitting walls are heated both by radiation and convection.

Another object of the present invention is to provide a radiant wall oven having a modular construction for easy assembly and replacement of parts, which minimizes labor and costs, and for better quality control.

Another object of the present invention is to provide a radiant wall oven for generating infrared radiation with a nonuniform temperature distribution which is simple in design, durable in structure, and reliable as well as efficient in operation.

BRIEF DESCRIPTION OF THE DRAWINGS

The present invention can be better understood with reference to the following drawings. The drawings are not necessarily to scale, emphasis instead being place upon clearly illustrating principles of the present invention.

DETAILED DESCRIPTION OF THE PREFERRED EMBODIMENTS

Figure 1:
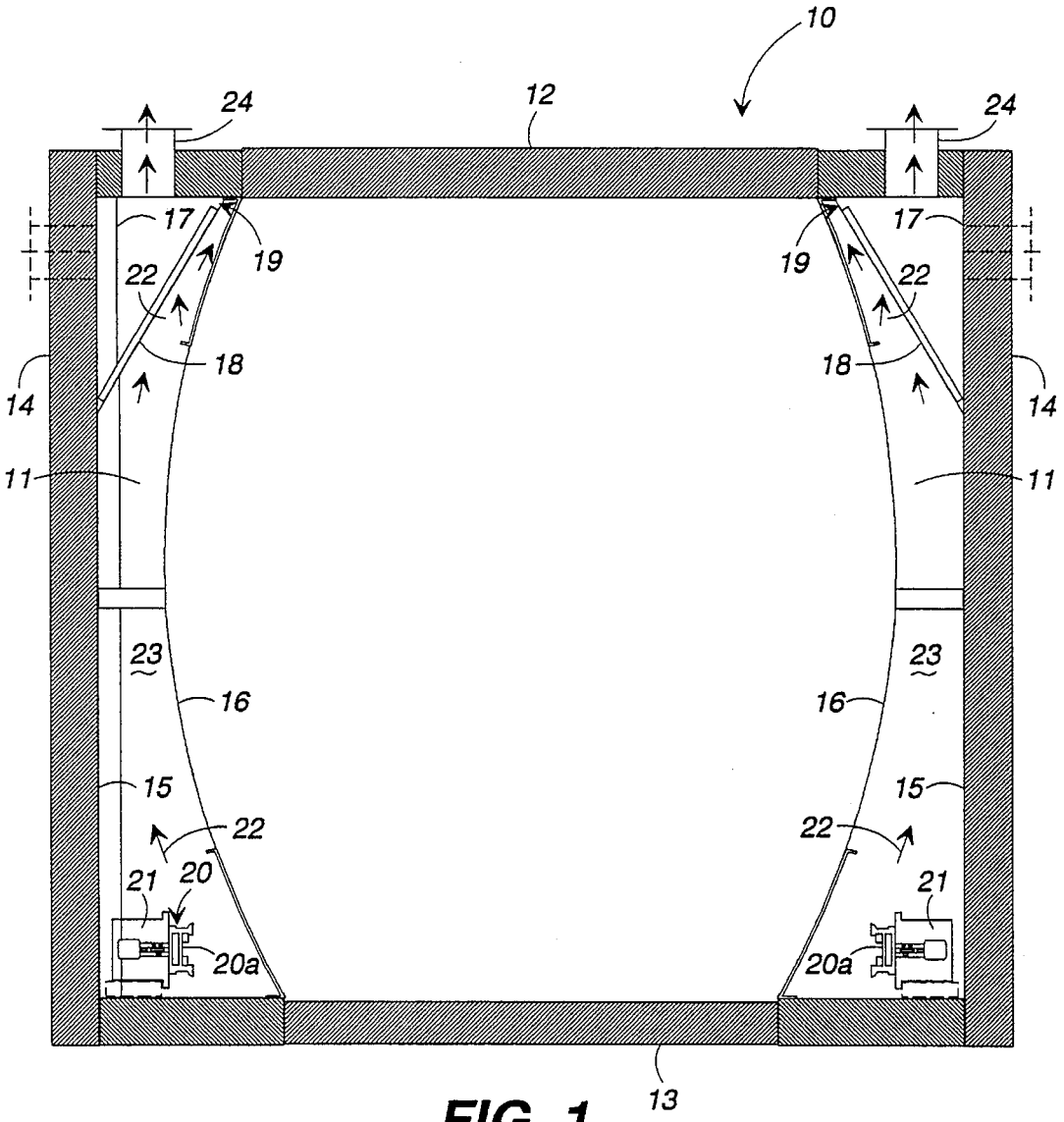
FIG. 1 is a front view of a modular radiant wall oven in accordance with the present invention.

Referring now to the figures wherein like reference numerals designate corresponding parts throughout the several views, FIG. 1 illustrates the novel radiant wall oven 10 in accordance with the present invention. The radiant wall oven 10 could be of modular construction and generally comprises spaced opposing radiant wall modules 11, a roof (or top) panel 12, and a floor (or bottom) panel 13. The foregoing elements collectively form a centralized elongated throughway for receiving an object to be heated or dried. The modular construction of the radiant wall oven 10, although not absolutely necessary, provides for easy assembly and replacement of parts, thereby optimally minimizing labor and costs, and provides for better quality control.

Figure 2A:
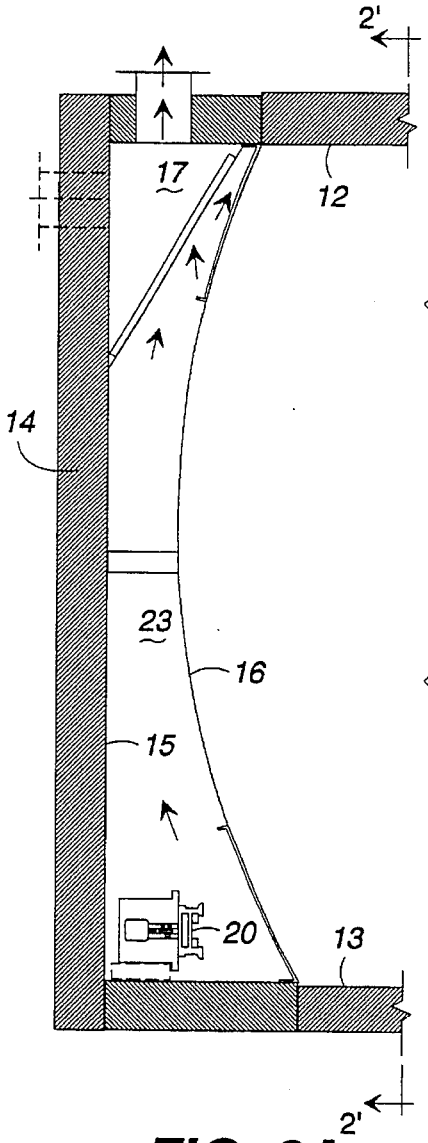
FIG. 2A is partial front view of the radiant wall oven of FIG. 1 showing a radiant emitting wall.
Figure 2B:
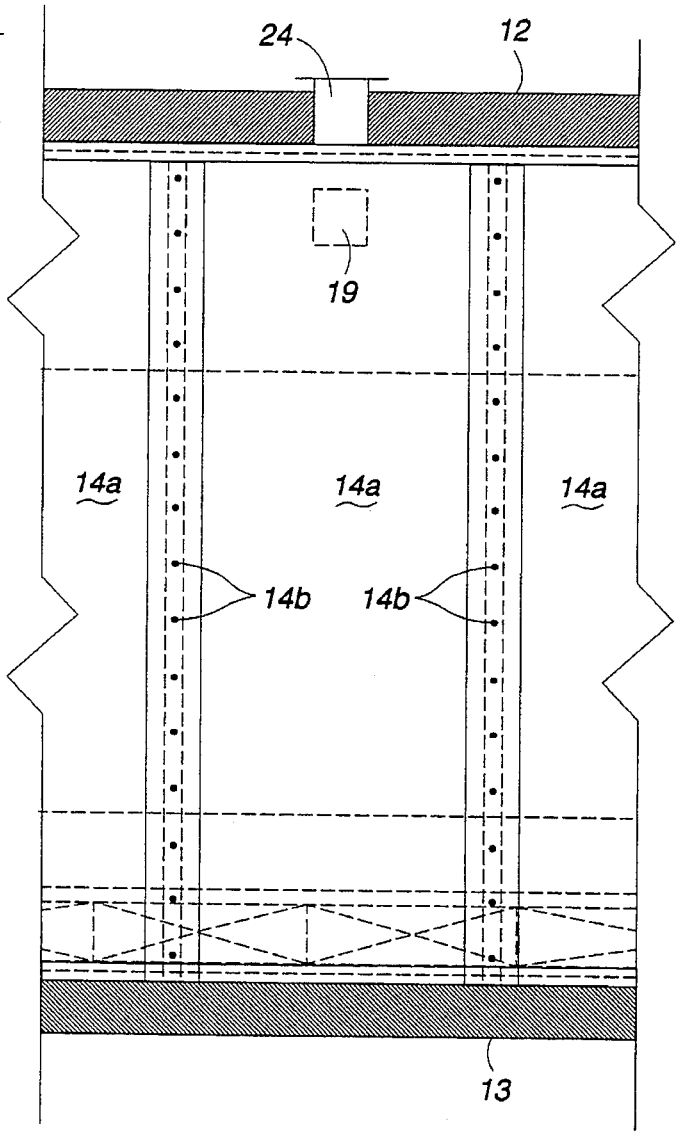
FIG. 2B is a cross sectional view of the radiant emitting wall of FIG. 2A taken along line 2'—2'.

The construction of the radiant wall modules 11 is illustrated in FIGS. 2A and 2B. As shown in FIG. 2B, the exterior wall 14 of each radiant wall module 11 is fabricated by interconnecting sheet metal panels 14*a* via any conventional affixing mechanism, such as bolts 14*b*. An insulating material is attached to or otherwise disposed against the exterior walls 14 to form an interior radiant emitting surface 15 of the radiant wall module 11. The interior radiant emitting surface 15 transfers heat by radiation to a radiant emitting wall 16 when heated to operating temperatures. In the preferred embodiment, the insulating material has an emissivity of greater than about 0.60. The interior radiant emitting surface 15 can also be sheet metal, but the exposed insulation works well, reduces cost, and provides a surface with better emissivity than sheet metal. It should also be mentioned that high density insulating material can be used on the wall 14 to increase the thermal inertia of the system.

Each radiant emitting wall 16 is mounted to spaced vertical supports in a manner which allows the exterior radiant emitting wall 16 to freely float, or move, to accommodate expansion and/or contraction. In the preferred embodiment, the radiant emitting walls 16 are curved. The curvature of each radiant emitting wall 16 is generally arcuate in its vertical dimension, being substantially concave along its inner surface and substantially convex along its outer surface throughout its vertical dimension. The curvature along the vertical dimension, measured along the curved portion of the surface of wall 16, should be greater than the height of any object on which curing or drying of the coating is required. It should also be mentioned that the radiant emitting wall 16 may also be provided with a coating to promote the transfer of infrared radiation. Preferably, the coating is a material having an emissivity of greater than approximately 0.9.

Within each radiant wall module 11, an exhaust chamber 17 is formed by a panel 18. Panel 18 further provides support for a roof section of the radiant wall module 11, which would otherwise be cantilevered from a vertical side panel 14. Exhaust ports 19 passes through panel 18 at the upper edge of panel 18. The angle of the panel 18 and the location of the exhaust ports 19 in panel 18 provides a means for assuring that the products of burner combustion flow up the full vertical dimension of radiant emitting wall 16. Furthermore, a linear-type burner 20 runs substantially the full longitudinal length of the radiant wall module 11. A suitable linear-type burner is described in my U.S. Pat. No. 5,062,788, which is incorporated herein by reference. The burner 20 is connected to a gas/air manifold 21.

Preferably, the energy output by the burner 20 is approximately between 3,000 and 35,000 BTUH per foot of the radiant emitting wall 16 measured along the longitudinal length of the wall 16. With the foregoing energy output, the exterior radiant emitting wall 16 is heated to an average equilibrium temperature of approximately between 200 and 800 degrees F. When the burner 20 is in operation, the products of burner combustion flow upwardly, as indicated by arrows 22 in FIG. 1, through the combustion chamber 23 formed by the inner wall 15 and the radiant emitting wall 16. At the top of the combustion chamber 23, the products of burner combustion enter port 19 into exhaust chamber 17 and exit through exhaust duct 24.

Figure 3B:
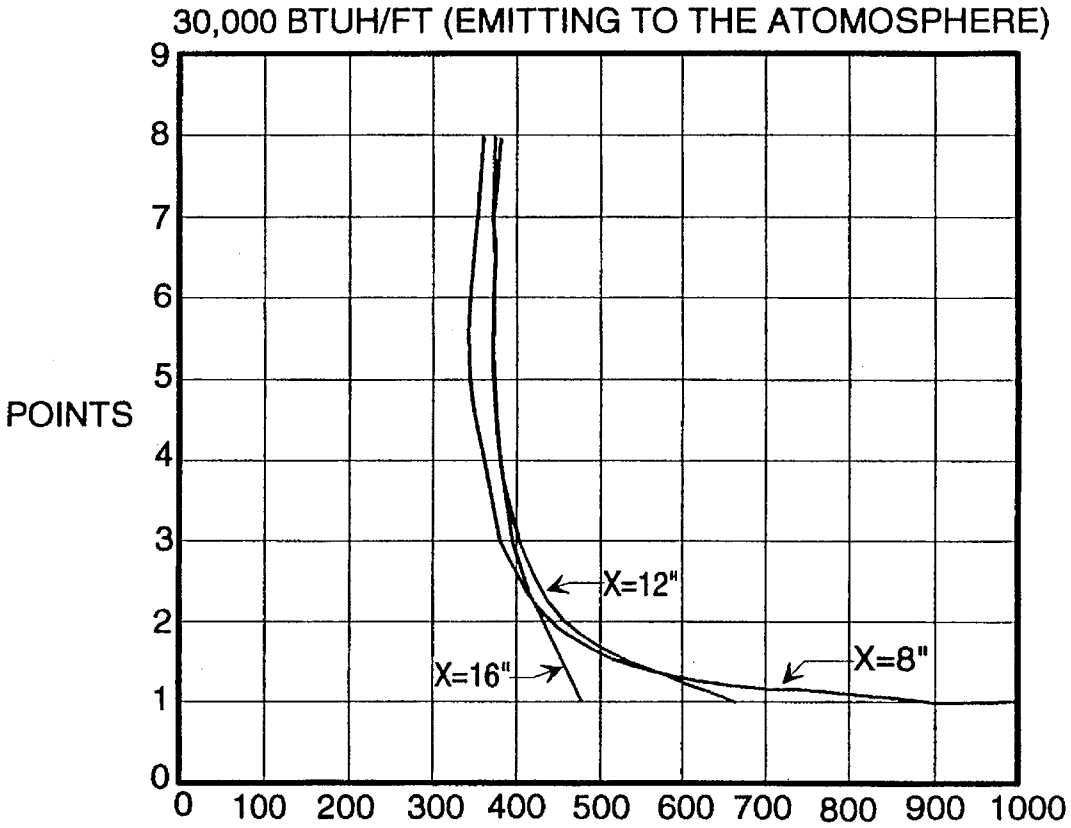
FIG. 3 is a graph of radiant emitting wall positions, or points, versus temperature indicating the nonuniform temperature distribution of infrared radiation along the radiant emitting wall of FIGS. 2A and 2B.
Figure 3A:
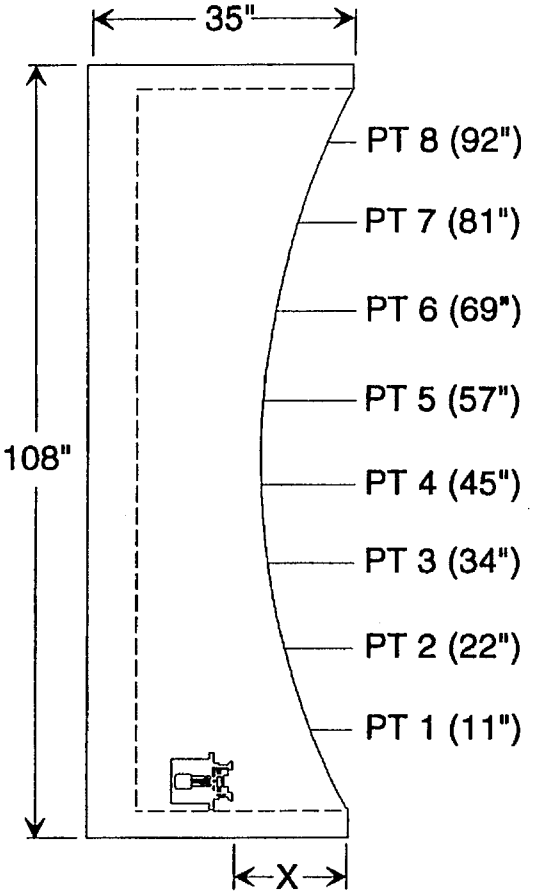

Significantly, it has been determined that the location of the burner 20 within the radiant wall module 11 determines the temperature distribution on the radiant emitting wall 16. In this regard, FIG. 3 is a graph of points, or positions, on the radiant emitting wall 16 versus temperature. The graph was generated for a radiant emitting wall 16 having arbitrary dimensions of 108 inches by 35 inches, as indicated. The graph demonstrates how the temperature distribution can be selectively varied by varying the horizontal distance between the burner combustion surface 20*a* of the burner 20 and the radiant emitting panel 16. As shown in the graph, the burner 20 may be positioned so that the upper and lower portions of the radiant emitting wall 16 exhibit disproportionate temperatures. In other words, the burner 20 can be positioned so that the lower portion of the wall 16 is much hotter than the upper portion of the wall 16.

A significant advantage of the oven 10 in accordance with the present invention is that a substantial portion of energy absorbed by the radiant emitting walls 16 can be transferred to walls 16 from the interior radiant emitting surfaces 15 in the combustion chambers 23 of the modules 11 through which the products of burner combustion pass. The interior radiant emitting surface 15 exhibits a higher temperature than the radiant emitting wall 16. Therefore, there is a net exchange of energy transferred in the form of infrared radiation from surface 15, or from any other surface forming the inner wall of the combustion chamber 23 through which the products of burner combustion can pass, to the radiant emitting wall 16. Depending upon the operating temperature of the wall 16, the amount of energy transferred by radiation from the interior radiant emitting surface 15 can vary between approximately 30 percent and 70 percent of the total amount of energy that is emitted by radiation from the wall 16. Because the exhaust gases move through the combustion chamber 23 very slowly, the convective heat transfer to the radiant emitting wall 16 is very low and is not influenced by forced turbulence. Therefore, the energy transferred to the radiant emitting wall 16 by infrared radiation is significant and contributes to the enhanced efficiency of the present invention. In fact, the majority of the radiant energy which is emitted from the radiant emitting wall 16 is at wavelengths of approximately equal to 5 microns or greater, which is well within the infrared radiation spectrum.

In addition, it should be mentioned that significant radiation is directly emitted from the combustion surface 20*a* of burner 20, which to some extent, contributes to the increased temperatures on the lower portion of the radiant emitting wall 16 as the burner is placed closer to wall 16. Optionally, a flame retention cover (not shown) can be placed on the burner 20 to further enhance the amount of energy emitted from the burner 20 by infrared radiation.

The features and principles of the present invention have been described and illustrated above with reference to a preferred embodiment. It will be apparent to those skilled in the art that numerous modifications may be made to the preferred embodiment without departing from the spirit and scope of the present invention. All such modifications are intended to be incorporated herein within the scope of the present invention, as defined hereinafter in the claims.

Wherefore, the inventor claims the following:

1. A radiant wall structure for radiating substantially infrared energy and having a temperature distribution characterized by higher temperatures associated with a lower portion thereof, comprising:

a radiant emitting wall having a exterior radiant energy emitting surface and an interior surface;

a second wall spaced outwardly a distance from said radiant emitting wall for defining a combustion chamber therebetween, said second wall having an interior radiant emitting surface and an exterior surface;

heating means for delivering heated gas through said combustion chamber, said heating means being disposed within said combustion chamber and having a burner combustion surface disposed adjacent to a lower portion of said radiant emitting wall so that said lower portion of said radiant emitting wall receives energy by radiation from said interior radiant emitting surface and by radiation and convection heat from said heating means and so that an upper portion of said radiant emitting wall receives energy by radiation from said interior radiant emitting surface and convection heat from said heating means;

said heating means being a linear burner which extends substantially along the full longitudinal length of said radiant emitting wall.

2. The structure of claim 1, wherein said burner combustion surface is positioned approximately between 3 and 20 inches from said interior surface of said radiant emitting wall.

3. The structure of claim 1, wherein the energy output by the burner is approximately between 3,000 and 35,000 BTUH per foot of said radiant emitting wall measured along said longitudinal length.

4. The structure of claim 1, wherein said linear burner is controlled to heat said exterior radiant emitting wall to an average equilibrium temperature of approximately between 200 and 800 degrees F.

5. The structure of claim 1, wherein said interior radiant emitting surface comprises insulation material having an emissivity of greater than about 0.60.

6. The structure of claim 1, wherein said interior radiant emitting surface comprises a metal surface.

7. The structure of claim 1, wherein at least about 30% of said energy transferred to said radiant emitting wall is transferred by infrared radiation which is emitted from said interior radiant emitting surface.

8. The structure of claim 1, wherein said exterior emitting wall is flat along its emitting surface toward said combustion chamber.

9. The structure of claim 1, wherein said exterior emitting wall comprises a coating having an emissivity which is greater than about 0.9.

10. The structure of claim 1, wherein said exterior radiant emitting wall exhibits a temperature distribution which progressively decreases from said lower portion to an approximate vertical midpoint thereof.

11. The structure of claim 1, wherein said linear burner is controlled to heat said exterior radiant emitting wall to an operating temperatures where a majority of radiant energy emitted from said exterior radiant wall exhibits a wavelength of approximately greater than 5 microns.

12. The structure of claim 9, wherein said coating is a porcelain enamel.

13. An oven formed by spacing apart two of said radiant wall structures set forth in claim 12 so that said exterior radiant emitting wall of one structure opposes said exterior radiant emitting wall of the other structure.

14. A radiant wall structure for radiating substantially infrared energy and having a nonuniform temperature distribution, comprising:

a radiant emitting wall having an exterior radiant energy emitting surface and an interior surface and having a lower portion and an upper portion;

a second wall spaced outwardly a distance from said radiant emitting wall for defining a combustion chamber therebetween, said second wall having an interior radiant emitting surface and an exterior surface; and an elongated linear burner for delivering heated gas through said combustion chamber, said elongated linear burner being disposed within said combustion chamber and having a burner combustion surface residing in close proximity to a lower portion of said radiant emitting wall so that said lower portion of said radiant emitting wall receives energy from radiation from said burner combustion surface in addition to energy from the interior radiant emitting surface and from convective heat transfer from the products of combustion and so that said upper portion of said radiant emitting wall receives energy from primarily radiation from said interior radiant emitting surface and convection from said linear burner.

15. The structure of claim 14, wherein said burner combustion surface is positioned approximately between 3 and 20 inches from said interior surface of said radiant emitting wall.

16. The structure of claim 15, wherein the energy output by the burner is approximately between 3,000 and 35,000 BTUH per foot of said radiant emitting wall measured along said horizontal length.

17. The structure of claim 15, wherein said linear burner is controlled to heat said exterior radiant emitting wall to an average equilibrium temperature of approximately between 200 and 800 degrees F.

18. The structure of claim 15, wherein said interior radiant emitting surface comprises insulation material having an emissivity of greater than about 0.60.

19. The structure of claim 15, wherein said interior radiant emitting surface comprises a metal surface.

20. The structure of claim 15, wherein at least about 30% of said energy transferred to said radiant emitting wall is transferred by infrared radiation which is emitted from said interior radiant emitting surface.

21. The structure of claim 15, wherein said exterior emitting wall curves inwardly toward said combustion chamber.

22. The structure of claim 15, wherein said exterior emitting wall comprises a coating having an emissivity which is greater than about 0.9.

23. The structure of claim 15, wherein said exterior radiant emitting wall exhibits a temperature distribution which progressively decreases from said lower portion to an approximate vertical midpoint thereof.

24. The structure of claim 16, wherein said linear burner is controlled to heat said exterior radiant emitting wall to an operating temperatures where a majority of radiant energy emitted from said exterior radiant wall exhibits a wavelength of approximately greater than 5 microns.

25. The structure of claim 22, wherein said coating is a porcelain enamel.

26. An oven formed by spacing apart two of said radiant wall structures set forth in claim 25 so that said exterior radiant emitting wall of one structure opposes said exterior radiant emitting wall of the other structure.

27. A modular oven for heating products via infrared radiation, comprising:

(a) a first radiant wall module and a second radiant wall module being spaced apart and connected via a top panel and a bottom panel to form a throughway for heating said products passed therethrough along an axis;

(b) said first and second radiant wall modules each comprising:

(1) a radiant emitting wall having an exterior radiant energy emitting surface and an interior surface, said radiant emitting wall being continuously curved about said axis;

(2) a second wall spaced outwardly from said radiant emitting wall for defining a combustion chamber therebetween, said second wall having an interior radiant emitting surface and an exterior surface; and (3) heating means for delivering heated gas through said combustion chamber, said heating means being disposed within said combustion chamber and having a burner combustion surface disposed adjacent to a lower portion of said radiant emitting wall so that said radiant emitting wall receives energy by radiation from said interior radiant emitting surface and convection and radiation from said burner means.

28. The oven of claim 27, wherein said heating means is a linear burner which extends substantially along the full horizontal length of said radiant emitting wall.

29. The oven of claim 28, wherein said burner combustion surface is positioned approximately between 3 and 20 inches from said interior surface of said radiant emitting wall.

30. The oven of claim 29, wherein said linear burner is controlled to heat said exterior radiant emitting wall to an operating temperature where a majority of radiant energy emitted from said exterior radiant wall exhibits a wavelength of approximately greater than 5 microns.

31. The oven of claim 30, wherein the energy output by the burner is approximately between 3,000 and 35,000 BTUH per foot of said radiant emitting wall measured along said longitudinal length while the oven is at equilibrium temperature.

32. The oven of claim 30, wherein said linear burner is controlled to heat said exterior radiant emitting wall to an average equilibrium temperature of approximately between 200 and 800 degrees F.

33. The oven of claim 30, wherein said interior radiant emitting surface comprises insulation material having an emissivity of greater than about 0.60.

34. The oven of claim 30, wherein said interior radiant emitting surface comprises a metal surface.

35. The oven of claim 30, wherein at least about 30% of said energy transferred to said radiant emitting wall is transferred by infrared radiation which is emitted from said interior radiant emitting surface.

36. The oven of claim 30, wherein said exterior emitting wall comprises a coating having an emissivity which is greater than about 0.9.

37. The oven of claim 30, wherein said exterior radiant emitting wall exhibits a temperature distribution which progressively decreases from said lower portion to an approximate vertical midpoint thereof.

38. The oven of claim 36, wherein said coating is a porcelain enamel.

39. A process for radiating substantially infrared energy from an emitting surface, with a nonuniform temperature distribution, comprising the steps of:

forming a radiant emitting wall, with a continuous curvature about an axis, having an exterior radiant energy emitting surface and an interior surface and having lower and upper portions;

disposing a second wall spaced a distance from said radiant emitting wall for defining a combustion chamber therebetween, said second wall having an interior radiant emitting surface and an exterior surface; and delivering heated gas through said combustion chamber from a heating means disposed within said combustion chamber by burning products of combustion surface residing adjacent to one of said portions of said radiant emitting wall; and positioning said burner combustion surface a prescribed distance from said interior surface of said radiant emitting wall so that said radiant emitting wall exhibits nonuniform temperature distribution wherein said one of said portions of said radiant emitting surface is maintained at a higher temperature than said upper portion.

40. A radiant wall module formed by the process of claim 39.

41. The process of claim 39, further comprising the step of positioning said burner combustion surface so that said upper portion of said radiant emitting wall receives the combination of radiant heat from said interior radiant emitting surface and convective heat from said heating means and so that said lower portion of said radiant emitting wall receives the combination of radiant heat and convective heat from said burner means and radiant heat from said interior radiant emitting surface.

42. The method of claim 39, further comprising the step of changing said distance so as to change the nonuniform temperature distribution.

43. A process for radiating substantially infrared energy with a nonuniform temperature distribution from an emitting surface, comprising the steps of:

providing a heating apparatus having (i) a radiant emitting wall with an exterior radiant energy emitting surface and an interior surface, said radiant emitting wall having two portions, (ii) a second wall spaced outwardly from said radiant emitting wall for defining a chamber therebetween, said second wall having an interior radiant emitting surface and an exterior surface, and (iii) a heating means within said combustion chamber, said heating means having a heating source adjacent to one of said portions of said radiant emitting wall;

emitting heat nonuniformly from said exterior radiant energy emitting surface so that said one of said portions of said radiant emitting surface is maintained at a higher temperature than the other of said portions;

insulating said exterior wall of said second wall for causing said second wall to be heated to a temperature higher than said radiant emitting wall so that an appreciable amount of radiant energy is radiated from said interior radiant emitting surface when said chamber is heated; and directing radiant and convective heat from said heating source and radiant heat from said interior radiant emitting surface against said one of said portions of said radiant emitting wall;

directing radiant heat from said interior radiant emitting surface and convective heat from said heating means against the other of said portions of said radiant emitting surface, so that one of said portions emits substantially more radiant energy than the other of said portions; and regulating said conductive heat for maintaining a prescribed difference in temperature between said portions.

44. A process for radiating substantially infrared energy with a nonuniform temperature distribution from an emitting surface, comprising the steps of:

providing a heating apparatus having (i) a radiant emitting wall with an exterior radiant energy emitting surface and an interior surface, said radiant emitting wall having two portions, (ii) a second wall spaced outwardly from said radiant emitting wall for defining a combustion chamber therebetween, said second wall having an interior radiant emitting surface and an exterior surface, and (iii) a heating means within said combustion chamber, said heating means having a burner combustion surface adjacent to one of said portions of said radiant emitting wall;

emitting heat nonuniformly from said exterior radiant energy emitting surface so that said one of said portions of said radiant emitting surface is maintained at a higher temperature than the other of said portions; and varying the position of said burner combustion surface relative to said one of said portions of said radiant emitting wall so as to change the nonuniform temperature distribution of said radiant emitting wall.

45. A radiant wall structure for radiating substantially infrared energy for drying or curing coatings on the surfaces of objects comprising:

(a) a first radiant emitting wall having a radiant emitting outer surface and a radiant absorbing inner surface, said first radiant emitting wall having a length in a longitudinal direction;

(b) a second wall spaced from said radiant absorbing inner surface of said first radiant emitting wall for defining therebetween a chamber, said second wall having an interior radiant emitting surface, said inner radiant absorbing surface of said first wall and said inner radiant emitting surface of said second wall being in opposed relationship to each other;

(c) a gaseous burner for delivering heated gases into said chamber for heating by convection said inner emitting surface of said second wall and said radiant absorbing surface of said first wall, said burner being located within the lower portion of said chamber and extending substantially the length of said first radiant emitting wall; said burner, when lighted, emitting infrared radiant energy to said absorbing surface of said first wall and to said inner radiant absorbing surface of said second wall;

(d) insulation for said second wall for restricting the loss of heat to the exterior of said second wall sufficiently for the average temperature of said radiant emitting surface of said second wall to appreciably exceed the average temperature of said first radiant emitting wall thereby transfering radiant energy from inner emitting surface to said radiant absorbing surface of said first radiant emitting wall;

(e) the average fixed emission intensity, for a specific energy input between the lower and upper segments of the wall being dependent on the distance from the combustion surface of the burner and said first emitting wall;

(f) the energy input to said gaseous burner, at an equilibrium temperature of the first radiant emitting wall averaging between about 3,000 BTUH and about 35,000 BTUH per foot of said first emitting radiant wall in its longitudinal direction;

(g) means for supporting an object sufficiently located with respect to said first radiant emitting wall, that surfaces of said object absorb radiant emission from said first radiant emitting wall;

(h) the heat delivered from said second wall to said first wall by radiation being between about 30% and 70% of the total heat delivered to said first wall; and (i) said gaseous burner heating said radiant emitter of said second wall for generating infrared heat, said second wall being so positioned with respect to said first wall and said gaseous burner being so located that said infrared heat is directly by the emitting surface of said second wall toward said infrared absorbing surface of said first wall, said first wall and said burner being so positioned that increments of said first wall are heated to radiate at different temperatures.

46. An oven for drying coatings on successive objects, comprising:

a pair of spaced, opposed, inner walls defining a central heating zone through which said successive objects are passed from one end portion of said zone to the other end portion of said zone along a substantially linear path of travel;

a floor between said opposed walls and over which said objects are passed;

a top for said heating zone;

outer walls respectively outwardly of said opposed walls for defining, with said walls, heating chambers on opposite sides of said central heating zone;

said opposed walls having opposed inner infrared emitting surfaces facing said path of travel of said objects, and opposed walls having outer infrared absorbing surfaces;

said outer walls having infrared emitting surfaces respectively opposite to said infrared absorbing surfaces;

said outer walls having outer surfaces outwardly of said infrared emitting surfaces of said outer walls;

insulation for said outer surfaces of said outer walls for appreciably restricting heat loss from said chambers through said outer walls;

linear burners disposed in said chambers for generating hot gases along the length of said chambers, for heating said inner walls and said outer walls, said hot gases heating said outer walls to average temperatures substantially higher than the average temperature of said outer walls and sufficiently for said infrared emitting surface of said outer walls to emit appreciable amounts of infrared heat toward said infrared absorbing surfaces of said inner walls for thereby heating said inner walls sufficiently for said infrared surfaces of said inner walls to emit infrared radiation toward said path of travel of said objects, the majority of such infrared radiation emitted toward said path of travel of said objects being at wave lengths of five microns or greater;

the position of said linear burner being approximately parallel to said path of travel of said objects and being at a prescribed height and position in said chambers, such that the convection heating by said hot gases and the radiation generated by said infrared emitting surfaces of said outer walls will heat one of the longitudinal increments of said inner walls to greater extents than other of the longitudinal increments of said wall whereby greater amounts of infrared heat are generated by said one of said longitudinal increments.

47. The oven defined in claim 46 wherein the energy input to said linear burner at equilibrium temperature of said chambers is between 3,000 BTUH and 35,000 BTUH per foot of inner wall in a longitudinal direction.

48. The oven defined in claim 46 wherein said linear burner is provided with a surface disposed between approximately three inches and approximately twenty inches from the interior radiant absorbing surface of said inner walls.

49. The oven defined in claim 46 wherein said infrared emitting surfaces of said outer wall deliver between 30% and 70% of the total heat delivered to said inner wall.

50. The oven defined in claim 46 wherein said insulating surface of said outer wall comprises insulating material having an emissivity greater than 0.9.

51. The oven defined in claim 46 wherein said inner walls are formed of sheet metal.

52. The oven defined in claim 46 wherein at least 30% of the energy emitted by radiation from said outer walls is absorbed by the absorbing surfaces of said inner walls.

53. The oven defined in claim 46 wherein said inner walls are respectively concaved about horizontal axes for converging the infrared emissions from said emitting surfaces of said inner walls toward said objects.

54. The oven defined in claim 46 wherein the heat generated by said burner heats said chamber to between 200° F. and 700° F.

55. The structure defined in claim 46 wherein said linear burners are so disposed with respect to said inner walls that the temperature distribution along said inner walls progressively decreases from the lower portion of said inner walls to an approximately vertical midpoint thereof.

56. The structure defined in claim 46 wherein the outer heat emitting surfaces of said inner walls is formed of porcelain enamel.

57. The oven defined in claim 46 wherein said infrared emitting surfaces of said inner walls are formed by coatings along substantially the entire surface of said inner walls and wherein the emissivity of said coating is greater than about 0.9.

* * * * *